United States Patent [19]

Morita

[11] 4,396,120

[45] Aug. 2, 1983

[54] PACKING MATERIAL

[75] Inventor: Jiro Morita, Shijonawate, Japan

[73] Assignee: Riken Spring Industry Co., Ltd., Osaka, Japan

[21] Appl. No.: 308,852

[22] Filed: Oct. 5, 1981

[30] Foreign Application Priority Data

Aug. 21, 1981 [JP] Japan ..... 56-124390

[51] Int. Cl.[3] ..... B65D 85/20; B65D 85/62; B65D 73/00

[52] U.S. Cl. ..... 206/460; 206/443; 206/499; 206/813; 206/820

[58] Field of Search ..... 206/460, 813, 330, 499, 206/446, 443; 539, 820, 445, 471

[56] References Cited

U.S. PATENT DOCUMENTS

| | | | |
|---|---|---|---|
| 2,165,539 | 7/1939 | Dahlgren | 206/460 |
| 2,372,072 | 3/1945 | Flaws, Jr. | 206/330 |
| 2,744,624 | 5/1956 | Hoogstoel et al. | 206/813 |
| 3,033,412 | 5/1962 | Fox | 206/446 |
| 3,130,836 | 4/1964 | Conrad | 206/499 |
| 3,702,653 | 11/1972 | Mottin et al. | 206/539 |
| 4,232,787 | 11/1980 | Holiday | 206/820 |

*Primary Examiner*—William T. Dixson, Jr.
*Attorney, Agent, or Firm*—Wenderoth, Lind & Ponack

[57] ABSTRACT

A packing material especially for coil springs is proposed which provides for neat packing of springs without fear of springs intertwining each other. The packing material has a plurality of grooves or troughs for containing coil springs.

5 Claims, 9 Drawing Figures

PACKING MATERIAL

BACKGROUND OF THE INVENTION

The present invention relates to a packing material and particularly to a packing material for coil springs or similar articles.

Small parts or articles are generally sold packed, but coil springs are not packed individually but together because of variety in size and elasticity. For packing, they are put together into several bundles by a steel wire passing therethrough and tied at its ends. Therefore, they are apt to intertwine with each other in the package during transit, and before use they have to be disentangled.

SUMMARY OF THE INVENTION

An object of the present invention is to provide a packing material which can accommodate coil springs or similar articles more neatly so as not to intertwine with each other.

Another object of the present invention is to provide a packing material which facilitates packing of coil springs in such a manner as not to put them under stress during transit and which permits easy unpacking, making possible automatic mounting of springs.

Other objects and features of the present invention will become apparent from the following description taken with reference to the accompanying drawing, in which:

DETAILED DESCRIPTION OF THE INVENTION

Figure 1:
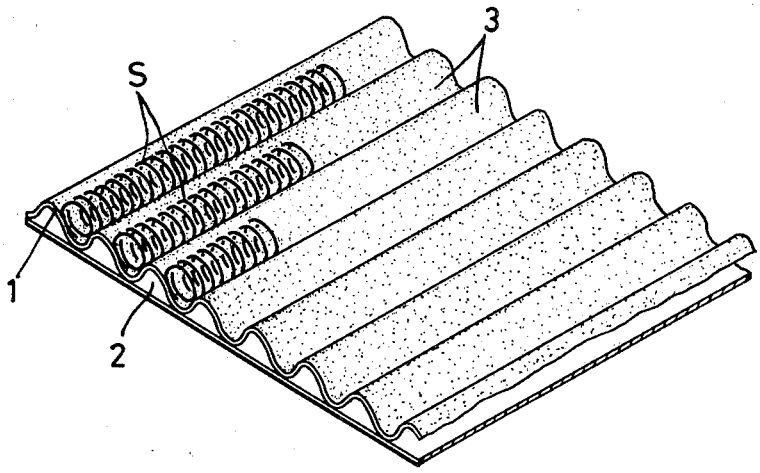
FIG. 1 is a perspective view of the first embodiment of the present invention.
Figure 2:
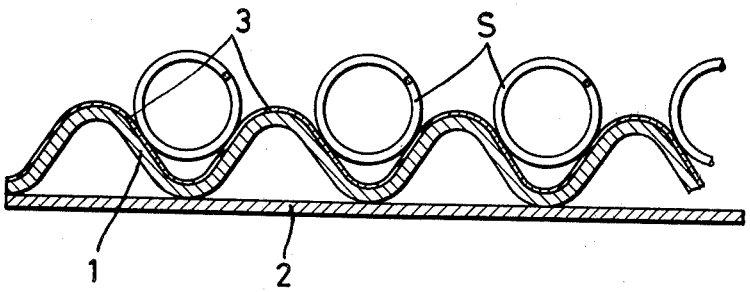
FIG. 2 is an enlarged vertical sectional view thereof showing it in use.

Referring to FIGS. 1 and 2 showing the first embodiment, a packing material comprises a single faced corrugated fiberboard which includes a medium liner 1 and a linerboard 2 adhered thereto. The corrugated medium liner 1 has a pressure-sensitive adhesive layer 3 on its outer surface. Coil springs S are arranged in grooves end-to-end between the corrugations and tentatively secured by the adhesive to the corrugated fiberboard. The linerboard 2 may be omitted.

Figure 3:
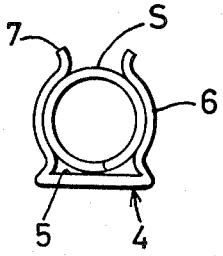
FIG. 3 is a side view of the second embodiment in use.
Figure 4:
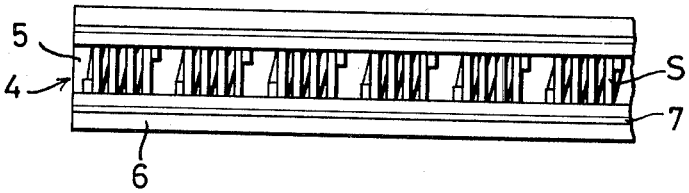
FIG. 4 is a plan view thereof.

Referring to FIGS. 3 and 4 showing the second embodiment, a packing material comprises a trough member 4 which has a base portion 5 and side wall portions 6 extending upwardly from the base portion. The wall portions are formed at their top with curled lips 7. The distance between the lips is normally narrower than the diameter of the spring.

The trough member 4 may be made of paper, metal as aluminum, synthetic resin such as polypropylene or styrol, or any other suitable material for containing springs. The material should be more or less flexible.

In use, the curled lips 7 are forced open and a plurality of coil springs S are arranged in the trough member 4. Since the trough members have a flat base portion 5, they can be lined neatly in a packing case after the springs have been set in the trough members. The provision of the curled ends facilitates the packing and unpacking of the springs into and out of the trough members. A wedge-like member may be used to pry open the lips of the trough member.

Figure 5:
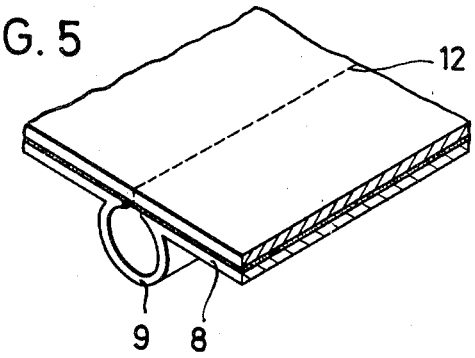
FIG. 5 is a perspective view of a portion of the third embodiment.
Figure 6:
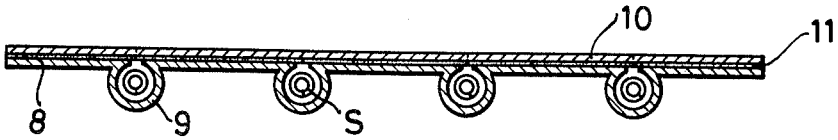
FIG. 6 is a vertical sectional view of the same.

Referring to FIGS. 5 and 6 showing the third embodiment, a packing material is made of a flexible material and comprises a base portion 8 formed with a plurality of troughs 9 for accommodating the coil springs 5 therein and a covering 10 having on its underside an adhesive layer 11 for covering the upper surface of the base portion 8 with the springs contained in the troughs. The covering 10 has perforations 12 in a plurality of lines so that the perforation lines will come over the troughs.

In use, when the base portion 8 together with the covering 10 is pulled from both sides, the covering will be easily broken at the perforation lines so that the springs will pop out of the troughs 9. If the perforations are not provided, the covering is peeled off the base portion. The troughs will open up and the springs can be easily taken out.

Figure 7:
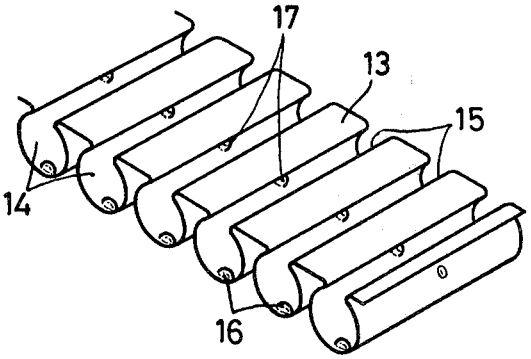
FIG. 7 is a perspective view of the fourth embodiment.
Figure 8:
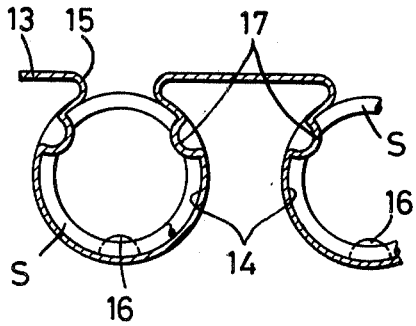
FIG. 8 is an enlarged vertical sectional side view of a portion of the same.
Figure 9:
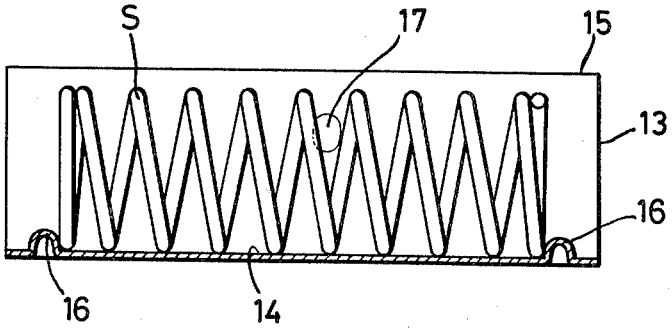
FIG. 9 is a vertical sectional front view of the same.

Finally, referring to FIGS. 7–9, the fourth embodiment comprises a flexible strip 13 made of a synthetic resin or other flexible material. The strip 13 is formed with a plurality of troughs 14 each having an opening 15 normally having a smaller width than the diameter of a coil spring S packed in the trough.

At each end thereof, the trough 14 is provided with a projection 16 to prevent the spring from getting out of the trough. The projection may be formed by hot molding. Further, a projection 17 is formed at each side on the inner wall of the trough 14 at a position adjacent to the opening 15 to prevent the springs S from moving about sidewise.

In use, the strip 13 is pulled from both sides to widen the openings 15 and coil springs S are set in the troughs 14 through the openings. When the strips are released from pulling, the openings will become narrow to hold in the springs. To take the springs out of the troughs, the strip is pulled again from both sides or the springs are pushed upward toward the openings from the bottom.

The flexible strip as the packing material can be used repeatedly if it is made of synthetic resin.

The flexible strip containing the springs can be curled up to save the space for storing.

It will be understood from the foregoing that the packing material in accordance with the present invention provides for tidy packing of coil springs or the like in such a manner that they can be easily taken out of the package without the necessity of disentangling them.

What we claim:

1. A packing material for coil springs or similar articles, said material comprising a corrugated fiberboard having an adhesive layer on the outer surface of the corrugations to fasten coil springs or similar articles in the grooves between the corrugations.

2. A packing material for coil springs or similar articles, said material comprising a trough member having a base and a pair of side wall portions extending upwardly from the base, said side wall portions having at their top end curled lips spaced from each other by a smaller distance than the diameter of said coil spring or similar article to be contained therein.

3. A packing material for coil springs or similar articles, said material being made of a flexible material and comprising a body portion formed with a plurality of troughs for accommodating said coil springs or similar articles therein and a covering having an adhesive layer on its underside adapted to cover the upper surface of the body portion with the coil springs contained in said troughs.

4. The packing material as claimed in claim 3 wherein said covering is provided with a number of perforation lines equal to the number of troughs said perforation lines being spaced to overlie said troughs.

5. A packing material for coil springs or similar articles, said material being made of a flexible material and comprising a strip formed with a plurality of troughs for accommodating said coil springs or similar articles therein each of said troughs being provided with a projection at each end thereof to prevent said coil spring or similar article from sliding out of the trough and a further projection at each side of said trough at a position adjacent to the opening of said trough to prevent sidewise movement of said coil springs.

* * * * *